US010139071B2

(12) United States Patent
Hogrefe et al.

(10) Patent No.: US 10,139,071 B2
(45) Date of Patent: Nov. 27, 2018

(54) MOTOR VEHICLE HEADLAMP WITH CONCAVE MIRROR REFLECTORS

(71) Applicant: Automotive Lighting Reutlingen GmbH, Reutlingen (DE)

(72) Inventors: Henning Hogrefe, Walddorfhaeslach (DE); Doris Boebel, Stuttgart (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 202 days.

(21) Appl. No.: 14/976,376

(22) Filed: Dec. 21, 2015

(65) Prior Publication Data

US 2016/0186953 A1 Jun. 30, 2016

(30) Foreign Application Priority Data

Dec. 22, 2014 (DE) ..... 10 2014 226 874

(51) Int. Cl.
*F21S 41/36* (2018.01)
*F21S 41/147* (2018.01)
(Continued)

(52) U.S. Cl.
CPC ..... *F21S 41/36* (2018.01); *F21S 41/141* (2018.01); *F21S 41/147* (2018.01); *F21S 41/663* (2018.01)

(58) Field of Classification Search
CPC ..... F21S 48/1388; F21S 48/115; F21S 41/36; F21S 41/147; F21S 41/141; F21S 41/663
See application file for complete search history.

(56) References Cited

U.S. PATENT DOCUMENTS

2001/0028565 A1 10/2001 Ishida
2004/0105275 A1 6/2004 Sazuka et al.
(Continued)

FOREIGN PATENT DOCUMENTS

CN 204005530 U 12/2014
DE 10340432 A1 3/2004
(Continued)

OTHER PUBLICATIONS

Official Report dated May 11, 2016 issued by the European Patent Office in European Patent Application No. 15194483.2.

*Primary Examiner* — Sharon E Payne
(74) *Attorney, Agent, or Firm* — Howard & Howard Attorneys PLLC

(57) ABSTRACT

A motor vehicle headlamp comprising a first semiconductor light source and a first concave mirror reflector, a second semiconductor light source and a second concave mirror reflector, and a third semiconductor light source and a third reflector. Each semiconductor light source includes at least two separate semiconductor chips. The second semiconductor light source includes a first group of semiconductor chips and a second group of semiconductor chips, and a control circuit, which operates either the first semiconductor light source without the third semiconductor light source, or the third semiconductor light source without the first semiconductor light source, operates at least a first portion of the semiconductor chips of the second semiconductor light source together with the first semiconductor light source, and operates at least a second portion of the semiconductor chips of the second semiconductor light source together with the third semiconductor light source.

12 Claims, 6 Drawing Sheets

(51) Int. Cl.
*F21S 41/141* (2018.01)
*F21S 41/663* (2018.01)

(56) References Cited

U.S. PATENT DOCUMENTS

| | | | | |
|---|---|---|---|---|
| 2008/0151547 | A1* | 6/2008 | Grotsch | F21K 9/00 362/257 |
| 2008/0225535 | A1* | 9/2008 | Mochizuki | B60Q 1/12 362/466 |
| 2009/0262549 | A1* | 10/2009 | Inoue | F21S 48/10 362/547 |
| 2014/0198517 | A1 | 7/2014 | Yamamoto et al. | |
| 2015/0116980 | A1 | 4/2015 | Li et al. | |

FOREIGN PATENT DOCUMENTS

| | | | |
|---|---|---|---|
| DE | 102012101919 | A1 | 9/2013 |
| EP | 2363320 | A1 | 9/2011 |
| EP | 2532951 | A2 | 12/2012 |
| JP | 2011129283 | A | 6/2011 |
| KR | 1020130000203 | A | 1/2013 |
| WO | 0101038 | A1 | 1/2001 |

* cited by examiner

MOTOR VEHICLE HEADLAMP WITH CONCAVE MIRROR REFLECTORS

CROSS-REFERENCE TO RELATED APPLICATIONS

The present application claims priority to and all the benefits of German Patent Application No. 10 2014 226 874.5, filed on Dec. 22, 2014, which is hereby expressly incorporated herein by reference in its entirety.

BACKGROUND OF THE INVENTION

1. Field of the Invention

The present invention relates to a motor vehicle headlamp having assemblies comprising semiconductor light sources and concave mirror reflectors for generating a low-beam light distribution and a high-beam light distribution, wherein the headlamp can be switched between one switching state, in which first semiconductor light sources are activated and in which the headlamp generates a low-beam light distribution, and a switching state in which second semiconductor light sources are activated and in which the headlamp generates a high-beam light distribution.

2. Description of the Related Art

Headlamps of this type, executed with a reflection system and with light emitting diodes functioning as semiconductor light sources, are known from various documents. For example, EP 2 532 951 discloses a reflection system having a reflector chamber, wherein the light source is moved during the switching between the low-beam light function, in which a low-beam light distribution is generated, and the high-beam light function, in which a high-beam light distribution is generated.

Moreover, a reflection system having a stationary light source, with an LED as the semiconductor light source, functioning with a reflector chamber, is disclosed in JP 2011129283. Corresponding systems having numerous reflector chambers are disclosed in DE 103 40 432.

SUMMARY OF THE INVENTION

The object of the present invention is to provide a headlamp functioning with semiconductor light sources, such as LEDs for example, for a low-beam and high-beam light, which is inexpensive and functions at a high performance level with regard to the light volume that it provides and the quality of the light distributions that it generates.

The motor vehicle headlamp according to the invention has an assembly comprising a first semiconductor light source and a first concave mirror reflector, a second semiconductor light source and a second concave mirror reflector, and a third semiconductor light source and a third concave mirror reflector. Each semiconductor light source is composed of at least two separate semiconductor chips. The second semiconductor light source is composed of a first group of semiconductor chips and a second group of semiconductor chips. The term "chips" always indicates a coherent, continuous, light emitting semiconductor surface in this patent application (which is normally coated with phosphor), in particular a light emitting diode (LED). Each chip represents a separate element in and of itself. In one design, numerous such elements are combined to form a coherent, rigid component. In order to make a distinction from such a component, which comprises numerous elements, components containing only one chip shall be referred to in the following as single-chip light sources, and components containing exactly two chips shall be referred to as double-chip light sources. The headlamp has a control circuit, which, when the headlamp is switched on, is designed to operate either the first semiconductor light sources without the third semiconductor light sources or the third semiconductor light sources without the first semiconductor light sources, and to operate at least a first portion of semiconductor chips of the second semiconductor light sources together with the first semiconductor light sources, and at least a second portion of the semiconductor chips of the second semiconductor light sources together with the third semiconductor light sources.

The first semiconductor light source illuminates the first reflector; the second semiconductor light source illuminates the second reflector, and the third semiconductor light source illuminates the third reflector. The assembly comprising the first reflector and the first semiconductor light source thus forms a first reflection module. The assembly comprising the second reflector and the second semiconductor light source thus forms a second reflection module. The assembly comprising the third reflector and the third semiconductor light source thus forms a third reflection module. The combination of three reflection modules makes it possible to generate the light distribution that is to be generated by superimposing partial light distributions, wherein each partial light distribution is generated by a reflection module comprising a concave mirror reflector and a semiconductor light source, and wherein an advantageously greater luminous flux is obtained on the whole. The individual reflection modules can each be optimized thereby, such that each reflection module fulfills a specific function particularly well in each case.

At least one of the reflection modules is designed to generate a fundamental light distribution through the shape of its concave mirror reflector. Another of the reflection modules is preferably designed to generate a concentrated spot light distribution, preferably for a high-beam. A further reflection module is preferably designed to generate a medium-wide light distribution. The fundamental light distribution is preferably wider than the medium-wide light distribution, and this is preferably wider than the spot light distribution. The different widths are generated, by way of example, by different shapes of the concave mirror reflectors, wherein the width is a function, in particular, of the shape in the horizontal direction in the intended use.

A reflection module, or two reflection modules as well, are furthermore preferably designed to generate a light/dark border necessary for generating a low-beam light distribution conforming to regulations. A light/dark border of this type runs horizontally with an intended use of the headlamp, at least in part.

Normally, semiconductor light sources having 1×2, 1×3, 1×4 or 1×5 LEDs per row on a common substrate are used in LED headlamps. Because semiconductor light sources are used in the present invention, which are composed of at least two separate semiconductor chips (i.e. they are not disposed on a common substrate), and are thus composed of single-chip light sources, there is a reduction in costs.

One design is distinguished in that, in each case, a reflector with a light source forms a reflection module, and in that, in each case, two reflection modules form a first pair of reflection modules, which can be activated in order to generate a low-beam light distribution, and in that, in each case, two reflection modules form a second pair of reflection modules, which can be activated in order to generate a high beam light distribution.

At least one reflection module may be designed to generate a light/dark border that is necessary for generating a low-beam light distribution that conforms with regulations.

Furthermore, the light exit surfaces of the reflectors may be the same size, and that the reflectors may be disposed such that their light exit surfaces border one another.

Each semiconductor light source may be composed of at least two separate semiconductor chips.

The semiconductor chips may each be disposed along a row, which row is disposed with its longitudinal extension such that it is transverse to the main beam direction of the reflector in a horizontal plane.

One of the three semiconductor light sources may include a row of semiconductor chips that is disposed at a diagonal in a horizontal plane with an intended use of the headlamp.

One of the reflector modules may be designed to generate both a portion of a low-beam light distribution as well as a portion of a high-beam light distribution, and that this reflection module may include two groups of semiconductor chips, which are disposed in rows.

Two reflection modules may be designed for generating a high-beam light distribution.

A first reflection module may be designed, through the shape of the first reflector, to generate a partial low-beam light distribution having a light/dark border, for a low-beam light distribution that conforms to the regulations. In doing so, the shape of sections of the reflector, which are aligned vertically in an intended use thereof, is of particular importance for the generation of the light/dark border. When referring to a vertical or horizontal orientation in the following, this always relates to an intended use of the headlamp.

A second reflection module may be a bi-functional module, which contributes to both the generation of the low-beam light as well as to the generation of the high-beam light.

A third reflection module may be designed to generate a partial high-beam light distribution, without a light/dark border, which extends beyond the height of the horizon in front of the vehicle with an intended use of the headlamp.

At least one of the reflection modules may be designed, by the shape of its concave mirror reflector, to generate a fundamental light distribution, a further reflection module may be designed to generate a concentrated spot light distribution, and yet another reflection module may be designed to generate a medium-wide light distribution, wherein the fundamental light distribution is wider than the medium-wide light distribution, and this is wider than the spot light distribution.

One shape of a reflector in substantially vertical sections of the reflector is also referred to in the following as having a vertical shape. One shape of a reflector in substantially horizontal sections of the reflector is also referred to in the following as having a horizontal shape.

A first reflection module may be designed, by a vertical shape of its reflectors, to generate the light/dark border, and may be designed to generate a medium-wide light distribution through its horizontal shape, while a second reflection module may be designed, through the horizontal shape of its reflector, to generate a wide fundamental light distribution.

The second reflection module is designed, through the vertical shape of its reflector, to generate a light/dark border, and, through the horizontal shape of its reflector, may be designed to generate a medium-wide light distribution, while the first reflection module may be designed, through a horizontal shape of its reflector, to generate a wide light distribution.

The first reflection module as well as the second reflection module may be designed, through the vertical shape of the respective reflector, to generate the light/dark border, and the second reflection module may be designed, through the horizontal shape of its reflector, to generate a medium-wide light distribution, while the first reflection module may be designed, through the horizontal shape of the focal length of its reflector, to generate a wide light distribution.

Both the first reflection module as well as the second reflection module may be designed, through the vertical shape of the respective reflector, to generate the light/dark border, and the first reflection module may be designed, through the horizontal shape of its reflector, to generate a medium-wide light distribution, while the second reflection module may be designed, through the horizontal shape of its reflector, to generate a wide light distribution.

At least one of the semiconductor light sources may include a single-chip light source, or a double-chip light source. With a semiconductor light source of this type, having a single-chip light source or a double-chip light source, this can be any semiconductor light source from the group of first semiconductor light sources, the second semiconductor light sources and the third semiconductor light sources.

Further advantages can be derived from the following description, the drawings and the dependent Claims. It is to be understood that the features specified above and still to be explained below can be used not only in the given combinations, but also in other combinations or in and of themselves, without abandoning the scope of the present invention.

Exemplary embodiments of the invention are depicted in the drawings and shall be explained in greater detail in the following description.

BRIEF DESCRIPTION OF THE DRAWINGS

The invention will be readily appreciated as the same becomes better understood by reference to the following detailed description when considered in connection with the accompanying drawings, wherein.

DETAILED DESCRIPTION OF THE INVENTION

Figure 1:
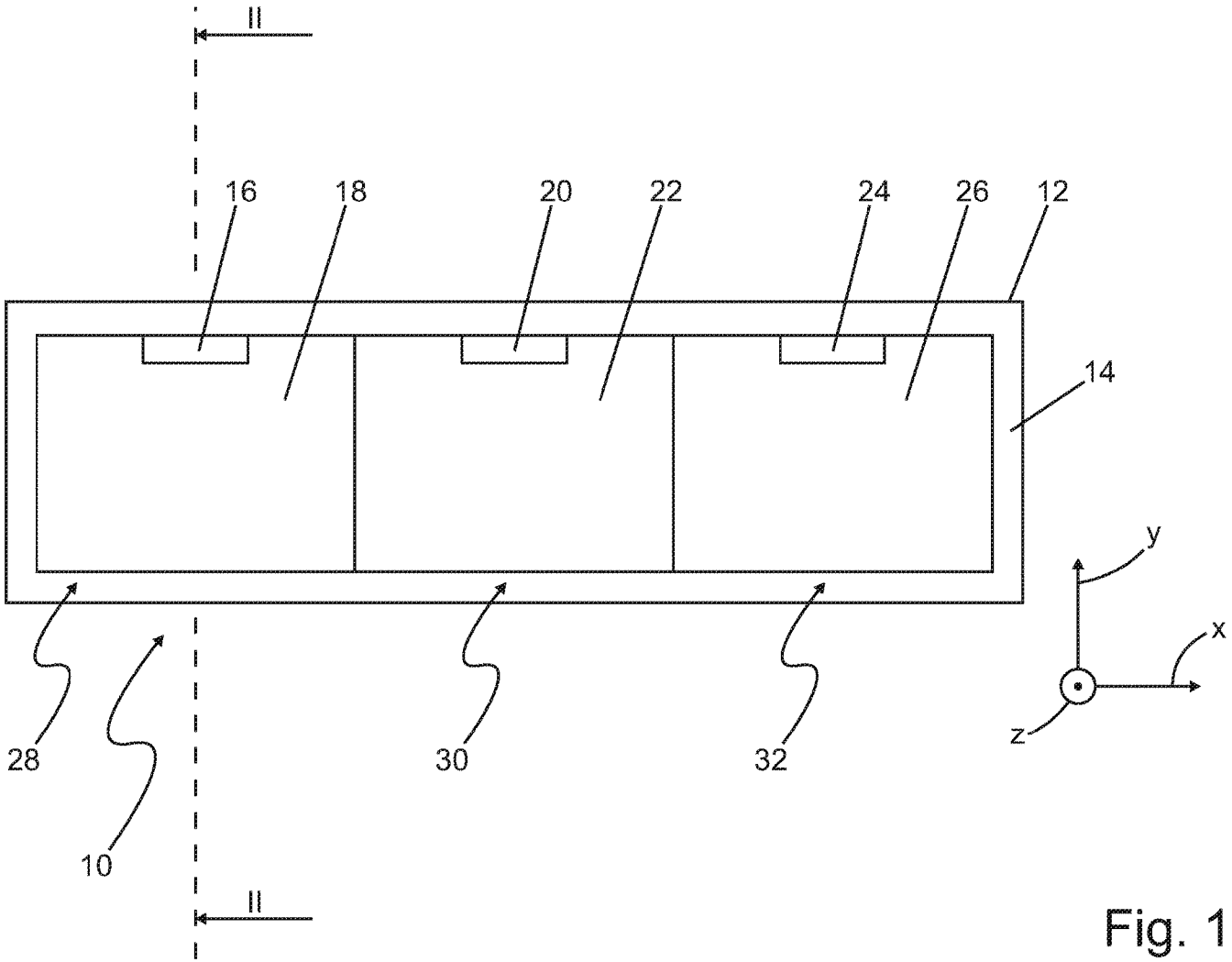
FIG. 1 shows a view of an exemplary embodiment of a motor vehicle headlamp according to the invention, from the front.

FIG. 1 shows, in detail, a view of an exemplary embodiment of a motor vehicle headlamp 10 according to the invention, from the front. The headlamp 10 has a housing 12, the light exit opening of which is covered by a transparent cover plate 14. The x-axis is parallel to the transverse axis of the vehicle in an intended use of the headlamp in a motor vehicle. The y-axis is parallel to the vertical, and the z-axis is parallel to the longitudinal axis, and indicates the main beam direction of the headlamp.

The headlamp 10 has an assembly comprising a first semiconductor light source 16 and a first concave mirror reflector 18, a second semiconductor light source 20 and a second concave mirror reflector 22, and a third semiconductor light source 24 and a third reflector 26.

The first semiconductor light source 16 forms, together with the first concave mirror reflector 18, a first reflection module 28. Analogously, the second semiconductor light source 20, together with the second concave mirror reflector 22, forms a second reflection module 30, and the third semiconductor light source 24 forms, together with the third reflector 26, a third reflection module 32. A reflection module with an activated light source is also referred to in the follow as an active reflection module.

Figure 2:
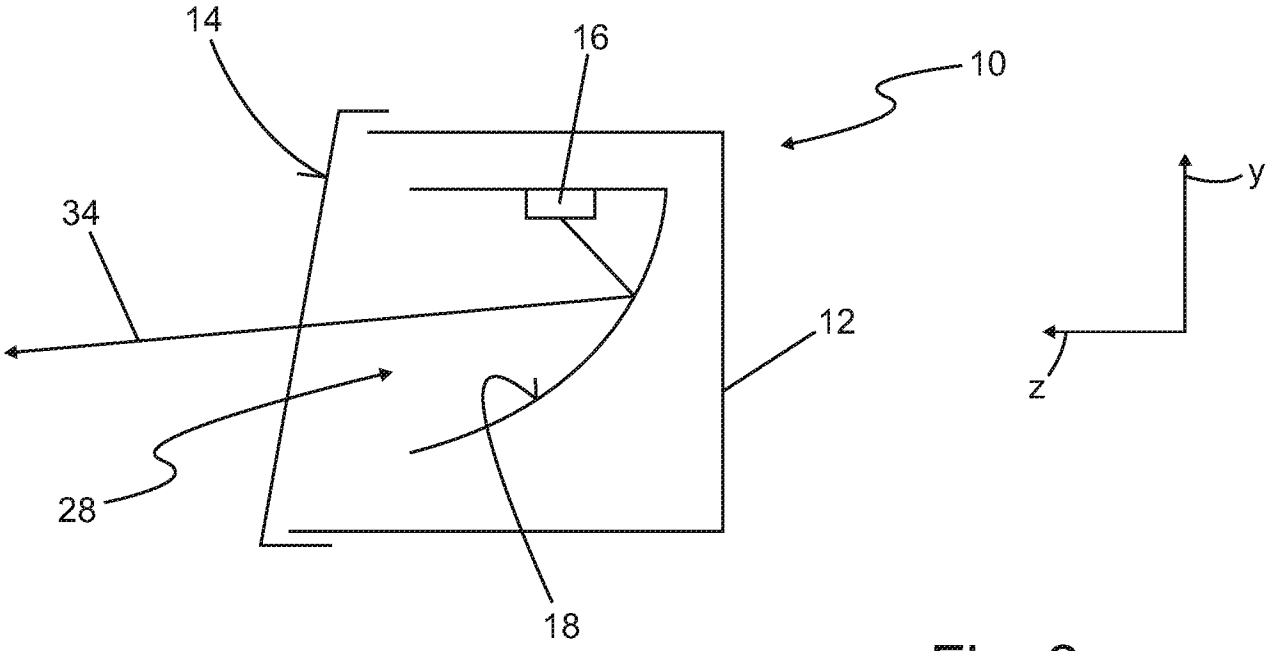
FIG. 2 shows a cross section of the subject matter of FIG. 1.

FIG. 2 shows a cross section of the subject matter of FIG. 1 cut along the line II-II in FIG. 1. The light 34 emitted downward from the semiconductor light source 16 into the half space is collected by the concave mirror reflector 18 and emitted, bundled in a main beam direction 7, in the region in front of the headlamp.

The light sources are disposed at the top of the reflectors in the subject matter of FIGS. 1 and 2. In an alternative design, the reflection module can also be used in a position rotated 180° about the horizontal axis, such that the light sources are disposed at the bottom of the headlamp. This applies for each reflection module individually as well as in conjunction with one or with both other reflection modules. Thus, all of the light sources may be disposed at the top, or all light sources may be disposed at the bottom, or at least one of the light sources may be disposed at the top and one light source may be disposed at the bottom.

The light exit surfaces of the reflectors may be the same size, and the reflectors may be disposed such that the light exit surfaces transition from one to the other, such that for the observer, a coherent projection image is obtained.

Figure 3:
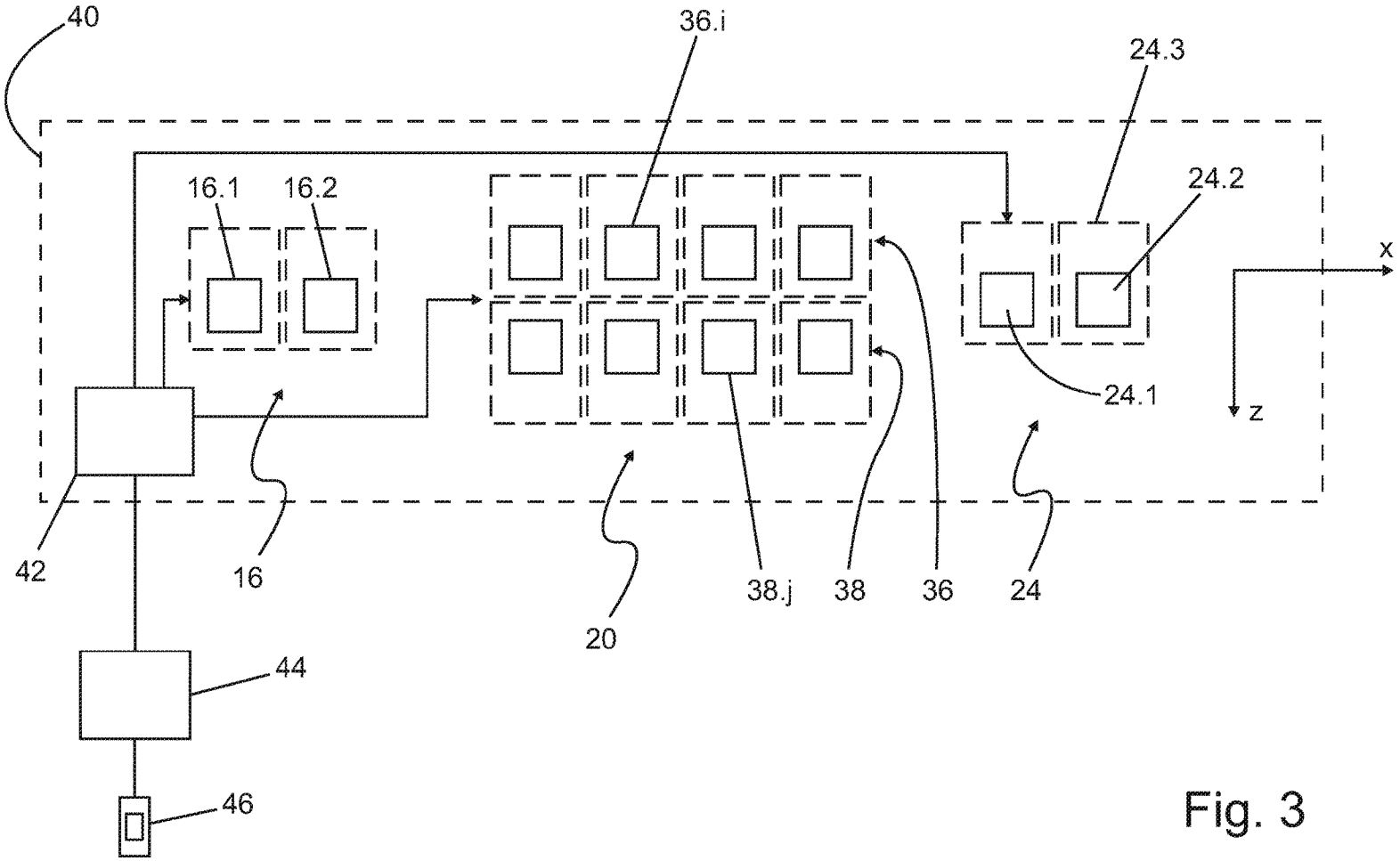
FIG. 3 shows a top view of the semiconductor light sources from FIG. 1, together with devices for controlling the semiconductor light sources, such as a control circuit.

FIG. 3 shows a top view of the semiconductor light sources 16, 20, 24 from FIG. 1. FIG. 3 illustrates a possible arrangement and composition of these semiconductor light sources from separate semiconductor chips in a schematic form, and is not to scale with FIG. 1.

Each semiconductor light source 16, 20, 24 is composed of at least two separate semiconductor chips. In the depicted exemplary embodiment, the first semiconductor light source 16 is composed of n=2 semiconductor chips 16.1, 16.2. The second semiconductor light source 20 is composed of a first group 36 of m=4 semiconductor chips 36.*i* and a second group 38 of k=4 semiconductor chips 38.*j*. The third semiconductor light source 24 is composed of l=2 semiconductor chips 24.1, 24.2. The values of n, m, k and l are not limited to the given values. Preferably, however, they are each greater than or equal to 2.

As stated above, normally semiconductor light sources having 1×2, 1×3, 1×4, or 1×5 LEDs per line on a common carrier substrate are used in LED headlamps. The headlamp manufacturer must then take the semiconductor light sources that are available from mass production that most effectively fulfill his requirements.

High performance semiconductor light sources that include single chips or double chips are already available, which are suited for low-beam light distributions and for high-beam light distributions. In order to be able to make use of such single chips and double chips, the carrier, e.g. the carrier 24.3, can extend only to a slight extent beyond the light emitting surface of the chip, in order to be able to form an overall lighting area from numerous single chip LEDs, which then exhibits no unlit spaces between the illuminating light exit surfaces.

Certain technical limitations obstruct the fulfillment of this requirement, which limitations arise due to requirements pertaining to the precise positioning of the chips on the carrier, and the thermal behavior of the chips on the carrier. A semiconductor light source that appears to be suitable for realizing the invention is the "Oslon compact" from Osram. Advantages of using such single or double chip light emitting diodes are derived, in particular, from their comparatively lower prices. LEDs designed as single chip LEDs are less expensive than multiple chip LEDs on a common carrier. A further advantage of the single chip and double chip LEDs over multiple chips is derived from a greater flexibility for the arrangement of the light exit surfaces in the reflector and the coordination of the luminous fluxes in various applications and the individual components in relation to one another. As double chips, LEDs having two chips that are tightly packed against one another may be considered as double chips. One example of such a double chip is the Oslon Black Flat 1×2. Such a double chip then replaces two single chips. The double chips can likewise be grouped together, as needed, in a flexible manner, to form larger light sources. This is also advantageous because the shape of the reflectors and the precise spatial distribution of the three reflector regions may differ from one type of headlamp to another, thus with headlamps for different types of vehicles. The effects of these differences on the light distributions generated from the various headlamps can be more readily compensated for with the use of single chips or double chips than with a use of components that have more than two light exit surfaces, because the possibility of varying the precise arrangement and/or number of single and/or double chips in relation to one another provides further degrees of freedom, which is not the case with a limitation to a use of components having more than two light exit surfaces that are arranged such that they cannot be altered spatially in relation to one another.

The semiconductor chips are disposed on a common printed circuit board 40. The common printed circuit board is preferably thermally coupled to a heat sink, which absorbs heat emitted during the operation of the semiconductor light sources, and discharges this heat.

One of the three semiconductor light sources, for example, one that contributes to the generation of both the low-beam light and the high-beam light, has a row of semiconductor chips, which may be disposed at a diagonal in the horizontal plane in an intended use, which plane in this case is the x-z plane.

In order to compensate for the interruptions in the lighted areas caused by the spacings of the light exit surfaces of the individual semiconductor chips, homogenization measures may be provided. One example of such a measure is the arrangement of attachment lenses directly in front of the light exit surfaces of the semiconductor chips. The attachment lenses may generate a coherent light exit surface, and thus a compensatory light source to a certain extent. Another example of a homogenization measure comprises a modulation of the reflector surfaces, in which the reflectors are designed such that they eliminate inhomogeneities in the projection image.

A control circuit 42 is also disposed on the printed circuit board in the depicted exemplary embodiment. The control circuit can also be disposed separately from the printed circuit board in the headlamp, or it can be disposed on the inside or outside of the headlamp. It is configured, in particular programmed, for controlling the luminous flux of the individual semiconductor light sources, comprising, in particular, the activating and deactivating thereof, and controlling the brightness. This control circuit is independent of its location. The control circuit may be controlled for its part by a superordinated control device 44 of the vehicle, which receives, for example, a signal from the driver for a light switch 46. The superordinated control device 44 signals to the control circuit 42 whether and possibly which light distribution is to be generated, and the control circuit 42 then controls the individual semiconductor chips on the basis of this, such that the desired light distribution is obtained.

Figure 4:
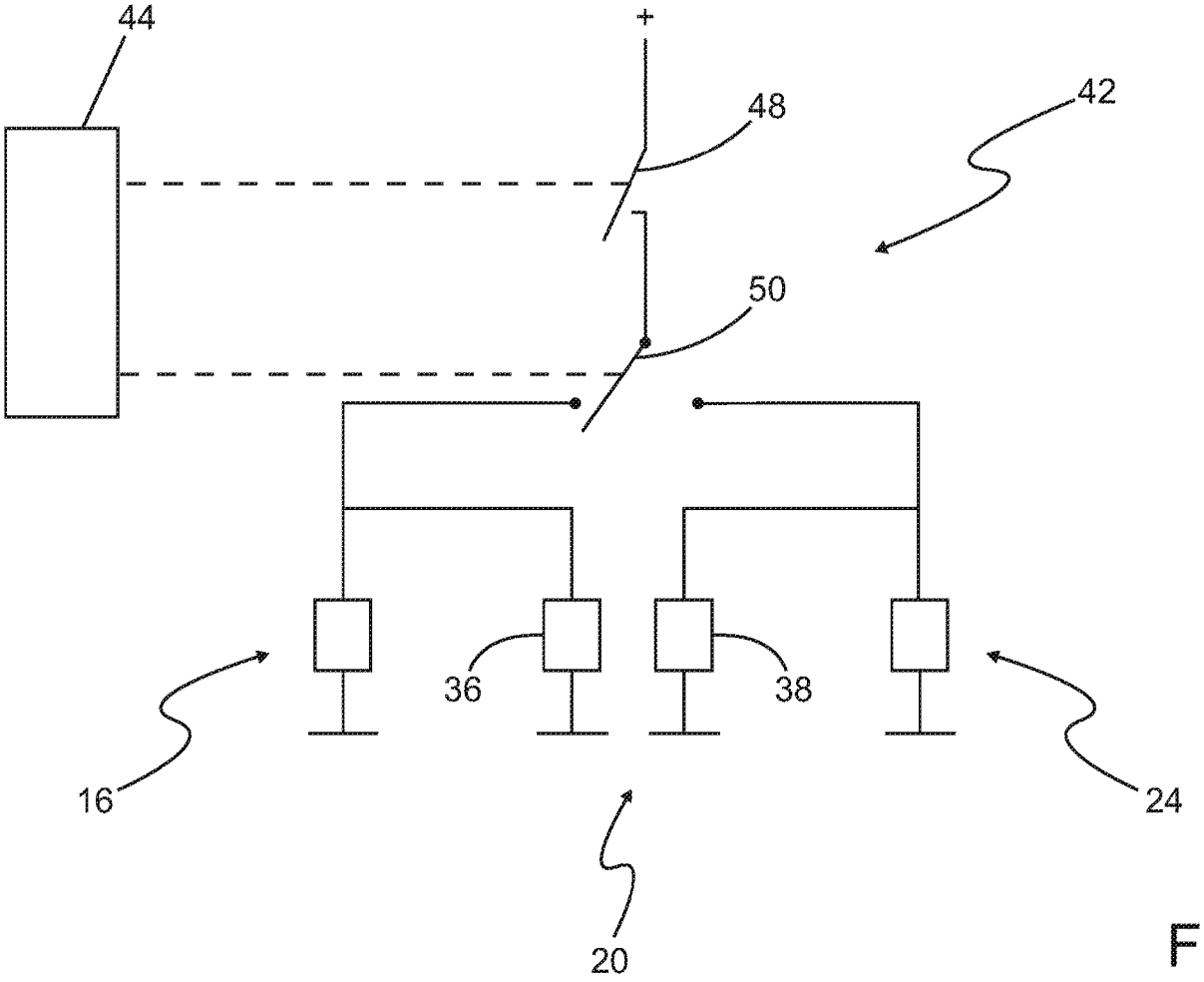
FIG. 4 show a control circuit, which collectively controls two groups of semiconductor chips of the second semiconductor light source.

FIG. 4 shows the control circuit 42 together with the three semiconductor light sources 16, 20, 24 and two switches 48, 50, with which the control device 44 controls the light emission of the three semiconductor light sources in a further design. The first switch 48 serves to activate a current supply for the semiconductor light sources and the second switch 50 serves to activate either the first semiconductor light source together with a first group 36 of semiconductor chips of the second semiconductor light source 20, or to activate the third semiconductor light source 24 together with a second group 38 of semiconductor chips of the second semiconductor light source.

Either the first 16 or the third semiconductor light source 24 may be connected to the first switch 48 via the second switch 50. The first group 36 of semiconductor chips of the second semiconductor light source 20 is always connected to the first semiconductor light source 16 in this exemplary embodiment.

The second group 38 of semiconductor chips of the second semiconductor light source 20 is always connected to the third semiconductor light source 24 in this exemplary embodiment.

When the first switch 48 is engaged, either the first semiconductor light source 16, together with the first group 36 of semiconductor chips of the second semiconductor light source 20, emits light, wherein the third semiconductor light source 24 remains inactive, or the third semiconductor light source 24, together with the second group 38 of semiconductor chips of the second semiconductor light source 20, emits light, wherein the first semiconductor light source 16 remains inactive.

FIG. 4 shows the first alternative, in which a current flows from supply potential (+) to the ground via the first switch 48, the second switch 50 and the first semiconductor light source 16, and wherein a further current path leads from the supply potential to the ground via the first switch, the second switch and the first group of semiconductor chips of the second semiconductor light source. With this design, the two groups of semiconductor chips of the second semiconductor light source are controlled separately from one another.

Figure 5:
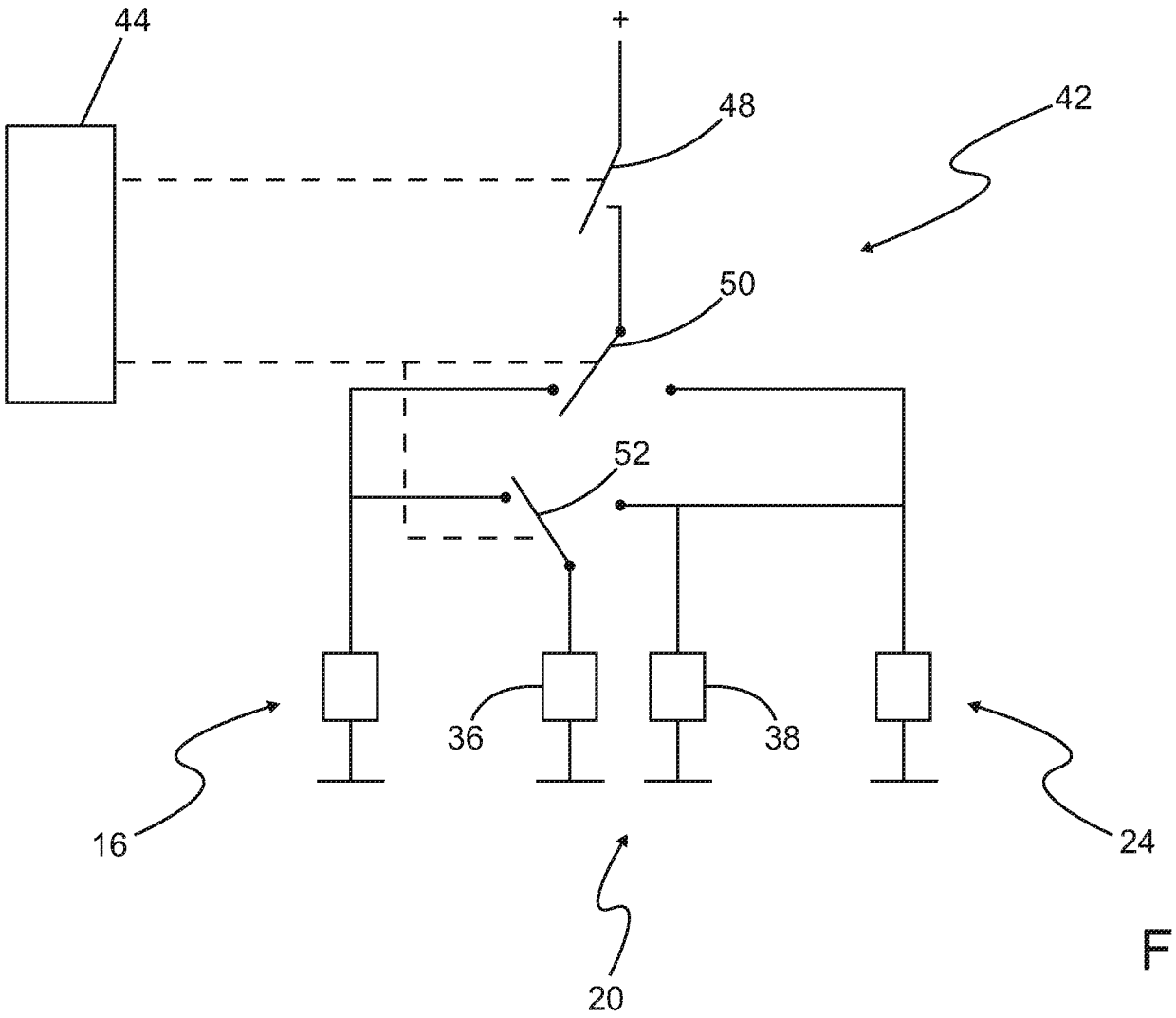
FIG. 5 shows a control circuit together with three semiconductor light sources in a further design.

FIG. 5 shows a control circuit 42 together with the three semiconductor light sources 16, 20, 24 and three switches 48, 50, 52, with which the control device 44 controls the light emissions of the three semiconductor light sources in a further design. The first switch 48 serves to activate a first current supply for the semiconductor light sources and the second switch 50 serves to alternatively activate the first semiconductor light source 16, wherein the third semiconductor light source 24 is deactivated, or the third semiconductor light source 24, wherein the first semiconductor light source 16 is deactivated. The second group 38 of semiconductor chips of the second semiconductor light source 20 is always electrically connected here to the third semiconductor light source 24, and is thus activated and deactivated collectively therewith. The first group 36 of semiconductor chips of the second semiconductor light source 20 is connected selectively, via the third switch 52, to the first semiconductor light source 16 or the second group 38 of semiconductor chips of the second semiconductor light source 20. The second switch 50 is actuated together with the third switch 52.

The first group 36 of semiconductor chips of the second semiconductor light source 20 is always activated in this exemplary embodiment when the first switch 48 is engaged.

When the first switch 48 is engaged, either the first semiconductor light source 16, together with the first group 38 of semiconductor chips of the second semiconductor light source, emits light, wherein the second group 38 of semiconductor chips of the second semiconductor light source 20 and the third semiconductor light source 24 remain inactive, or the third semiconductor light source 24, together with the first group 36 and the second group 38 of semiconductor chips of the second semiconductor light source 20, emits light, wherein the first semiconductor light source 16 remains inactive. The first alternative serves to generate a low-beam light distribution, and the second alternative serves to generate a high-beam light distribution.

FIG. 5 shows the first alternative, in which a current from a supply potential flows to the ground via the first switch 48, the second switch 50, as well as parallel thereto, via the first semiconductor light source 16 and via the third switch 52 and the first group 36 of semiconductor chips of the second semiconductor light source 20.

In the switch setting for high-beams that is not depicted, the third switch 52 connects the first group 36 of semiconductor chips of the second semiconductor light source 20 to the second group 38 of semiconductor chips of the second semiconductor light source 20, and the second switch 50 connects the combination of the second semiconductor light source 20 and the third semiconductor light source 24 to the side of the first switch 48 that is connected to the semiconductor light sources.

With this design as well, the two groups of semiconductor chips of the second semiconductor light source are controlled separately from one another.

Figure 6:
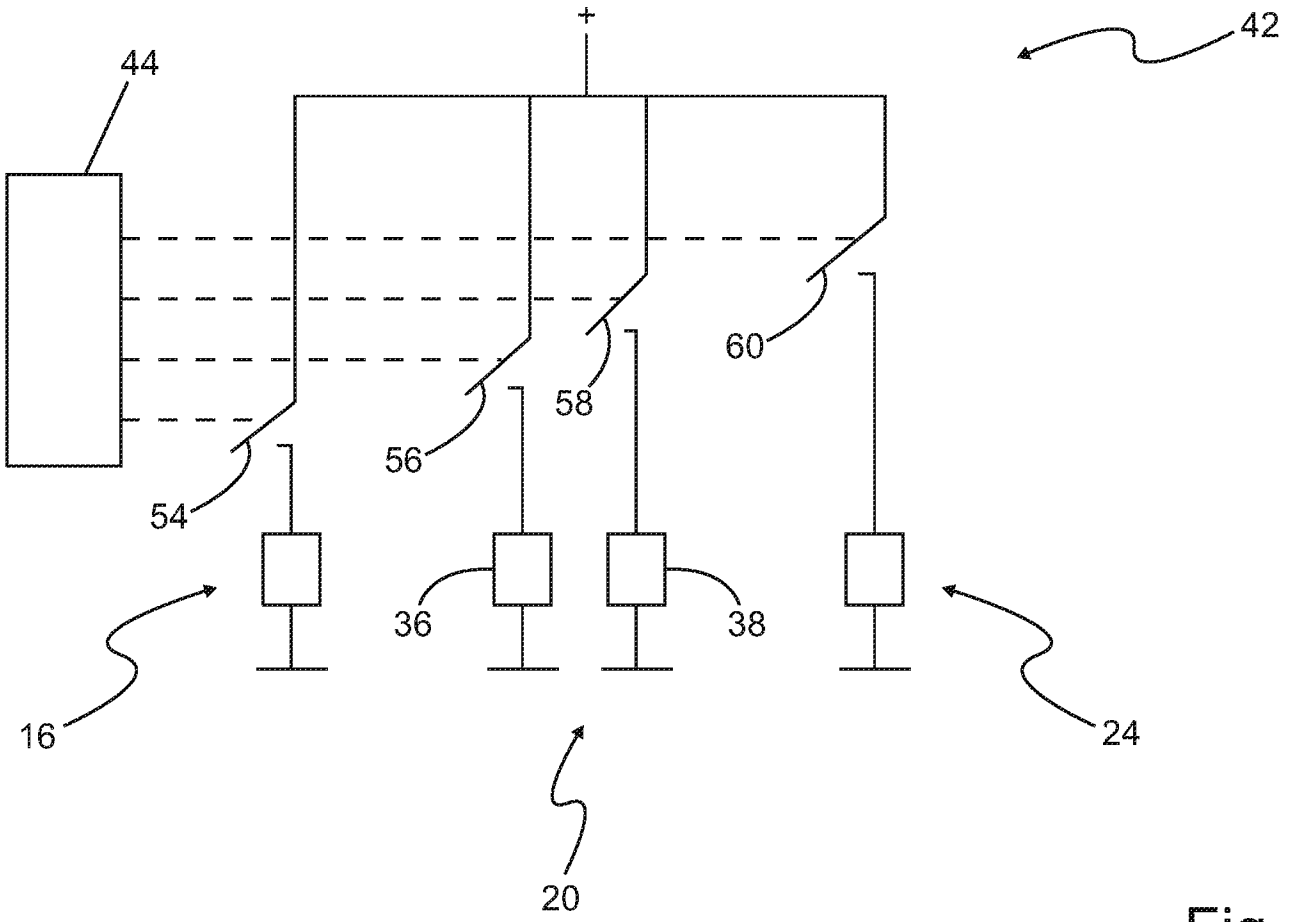
FIG. 6 shows a design in which the semiconductor light sources and groups of semiconductor chips can each be activated and deactivated individually and independently of one another.

FIG. 6 shows a design in which a fourth switch 54 lies together with the first semiconductor light source 16 in a first current path between the ground and the supply potential, a fifth switch 56 lies, together with the first group 36 of semiconductor chips of the second semiconductor light source 20, in a second current path between the ground and the supply potential, a sixth switch 58 lies, together with the second group 38 of semiconductor chips of the second semiconductor light source 20, in a third current path between the ground and the supply potential, and a seventh switch 60 lies, together with the third semiconductor light source 24, in a fourth current path between the ground and the supply potential. The four switches of this design are referred to as the fourth to seventh switches merely to distinguish them from the three switches from FIGS. 4 and 5.

The specified switches 54-60 can be activated in this design independently of one another, such that any combination of active switching states and inactive switching states of the first semiconductor light source 16, the first group 36 of semiconductor chips of the second semiconductor light source 20, the second group 38 of semiconductor chips of the second semiconductor light source 20, and the third semiconductor light source 24 can be set. The switching states of these switches 54-60 are controlled by the control device 44.

FIGS. 4 to 6 thus represent designs for headlamps according to the invention, wherein, in each case, two reflection modules form a first pair of reflection modules that can be activated to generate a low-beam light distribution, and wherein, in each case, two reflection modules form a second pair of reflection modules that can be activated to generate a high-beam light distribution. One of the reflection modules, in this case the second reflection module 30, contributes to both the generation of a low-beam light distribution as well as the generation of a high beam light distribution, and has two groups 36, 38 of semiconductor chips that are disposed, in particular, in rows. A first of these groups is activated in addition to the first semiconductor light source for generating the low-beam light. A second of these groups is activated in addition to the third semiconductor light source for generating the high-beam light. In one design, both of these groups are activated, in addition to the third semiconductor light source, in order to generate the high-beam light.

In the following explanation, reference is again made to FIGS. 1 to 3:

The headlight 10 has a reflection system with three reflectors 18, 22, 26. Each reflector is allocated to a semiconductor light source 16, 20, 24, such that, in each case, one reflector with a light source forms a reflection module 28, 30, 32. Two of the three reflection modules serve to generate a low-beam light distribution. With the subject matter of FIGS. 1 to 3, these are the first reflection module, formed by the first reflector and the first semiconductor light source, and the second reflection module, formed by the second reflector and the second semiconductor light source.

The first reflection module may be disposed closer to the outside of the vehicle in the intended use. The third reflection module 32 is disposed closer to a central longitudinal axis of the vehicle. The second reflection module is disposed between the first reflection module and the third reflection module.

Likewise, two reflection modules serve to generate a high-beam light distribution. With the subject matter of FIGS. 1 to 3, these are the second reflection module, formed by the second reflector and the second semiconductor light source, and the third reflection module, formed by the third reflector and the third semiconductor light source.

One of the three reflection modules serves to generate both the low-beam light distribution as well as to generate the high-beam light distribution, and thus represents a bi-functional module. With the subject matter of FIGS. 1 to 3, this is the second reflection module, formed by the second reflector and the second semiconductor light source.

This bi-functional module has two groups of semiconductor light sources. The groups are composed of single chips or double chips, each of which are disposed along a row in each group. The rows lie thereby with their longitudinal extension transverse to the main beam direction in a horizontal plane. The two rows are preferably offset to one another in the z-axis (main beam direction of the reflector). The spacing thereby, of the light emitting surfaces, is as small as possible, preferably smaller than a shortest side of the light emitting surface, but longer than zero, such that they do not come in contact with the light emitting surfaces. The light exit surfaces are thus disposed in the manner of a transverse reflection.

The first reflection module may be configured, through the shape of the first reflector, to generate a partial low-beam light distribution having a light/dark border for a low-beam light distribution conforming to regulations. This is achieved in that the first reflector is shaped such that its reflection image, thus the projections of the chip surfaces that are projected into the foreground in front of the reflector, do not extend beyond a specific line. Each surface element of the reflector projects such a reflection image, which can be made visible, for example, on a screen. The position of the reflection image on the screen can be predetermined by the shape of the reflector. It can thus be determined, for example, that all or at least most of such reflection images lie on one side of a specific line on the screen, based on which the combination of all of the reflection images forms the light/dark border. With an intended use of the headlight, the substantially horizontal light/dark border lies basically at the level of the horizon in front of the vehicle.

The third reflection module generates a partial high-beam light distribution without a light/dark border. With an intended use of the headlight, the high-beam light distribution extends beyond the height of the horizon in front of the vehicle.

The second reflection module generates partial light distributions that can be toggled between a low-beam light distribution or a high-beam light distribution. Typically, only one of the three reflection modules can be toggled. The invention is not limited thereby to only one of the three reflection modules being able to be toggled in order to generate various partial light distributions.

On the whole, each of the three reflection modules generates one respective partial light distribution, which differs from the partial light distribution of each of the two other reflection modules.

A total of four alternatives are preferred thereby. These four alternatives have in common that the second reflection module is a bi-functional module in the manner described above, and thus contributes to both the generation of the low-beam light as well as the generation of the high-beam light. There is a further common aspect in that the spot light distribution is generated in each case by the third reflection module.

In a first alternative, the first reflection module, by a shape of its reflector in substantially vertical sections of the reflector, acts to generate a light/dark border, and by a shape of its reflector in substantially horizontal sections of the reflector, acts to generate a medium-wide light distribution, while the second reflection module, by a shape of its reflector in substantially horizontal sections of the reflector, acts to generate a wide light distribution.

In a second alternative, the second reflection module, by a shape of its reflector in substantially vertical sections of the reflector, acts to generate the light/dark border, and by a shape of its reflector in substantially horizontal sections of the reflector, acts to generate a medium-wide light distribution, while the first reflection module, by a shape of its reflector in substantially horizontal sections of the focal length of the reflector, acts to generate a wide light distribution.

In a third alternative, both the first reflection module as well as the second reflection module, by a shape of their respective reflector in substantially vertical sections of the respective reflector, acts to generate a light/dark border, and the second reflection module, by a shape of its reflector in substantially horizontal sections of the reflector, acts to generate a medium-wide light distribution, while the first reflection module, by a shape of its reflector in substantially horizontal sections of the reflector, acts to generate a wide light distribution.

In a fourth alternative, both the first reflection module as well as the second reflection module, by a shape of their respective reflector in substantially vertical sections of the respective reflector, act to generate the light/dark border, and the first reflection module, by a shape of its reflector in substantially horizontal sections of the reflector, acts to generate a medium-wide light distribution, while the second reflection module, by a shape of its reflector in substantially horizontal sections of the reflector, acts to generate a wide light distribution.

With this listing of four alternatives, only one reflection module is implemented as a bi-functional module that can be toggled between functions. It would also be possible to implement a further reflection module as a bi-functional module, which would then create the possibility of other alternatives.

One reflection module may generate a fundamental light that is diffused to a somewhat greater extent. This is the first reflection module in the exemplary embodiments and designs presented here.

One reflection module may generate a concentrated spot light distribution, typically for high-beam light. This is the third reflection module in the exemplary embodiments and designs presented here.

One reflection module may generate a medium-wide light distribution. This is the second reflection module in the exemplary embodiments and designs presented here. One or two modules generate the light/dark border. These are preferably the first reflection module and the second reflection module.

With all of the alternatives, typically one of the reflection modules that contributes to the generation of the low-beam light distribution generates the light/dark border, distributes its light up to a few tenths of a degree below light/dark border, such that this module is not critical regarding tolerances.

One of the reflection modules, typically the reflection module serving as the spot module, is realized as a partial high-beam light module in one design, having a vertical light/dark border in its portion of the light distribution lying above the horizon, by which a high-beam light is created, having an adaptive dimmed zone for traffic participants in front of the vehicle in question. This vertical light/dark border separates a bright region on the side of the roadway in which the vehicle in question is located, from a dark region of the light distribution lying on the side of the road for oncoming traffic.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A motor vehicle headlamp having a reflection system with three reflectors, the headlamp comprising a first semiconductor light source and a first concave mirror reflector, which is a first one of the three reflectors, a second semiconductor light source and a second concave mirror reflector, which is a second one of the three reflectors, and a third semiconductor light source and a third concave mirror reflector, which is a third one of the three reflectors, wherein each semiconductor light source is composed of at least two separate semiconductor chips, wherein the second semiconductor light source is composed of a first group of semiconductor chips and a second group of semiconductor chips, and having a control circuit configured for operating either the first semiconductor light source together with the first group of semiconductor chips of the second semiconductor light source but without the third semiconductor light source, or the third semiconductor light source together with the second group of semiconductor chips of the second semiconductor light source but without the first semiconductor light source, and to operate at least the first group of semiconductor chips of the second semiconductor light source together with the fist semiconductor light source, wherein, in each case, one reflector with a light source forms a reflection module, so that the headlamp has three reflection modules and in that, in each case, two reflection modules of the three reflection modules form a first pair of reflection modules, which can be activated for generating a low-beam light distribution, and in that, in each case, two reflection modules of the three reflection modules form a second pair of reflection modules, which can be activated for generating a high-beam light distribution, wherein a first reflection module of the three reflection modules, by the shape of the first reflector, acts to generate a partial low-beam light distribution having a light/dark border for a low-beam light distribution conforming to regulations, wherein a second reflection module of the three reflection modules is a bi-functional module, that generates both a portion of a low-beam light distribution as well as a portion of a high-beam light distribution, and in that this second reflection module has two groups of semiconductor chips, which are disposed in rows, the rows lying with their longitudinal extension transverse to the main beam direction in a horizontal plane and the rows are offset to one another in the main beam direction of the reflector, wherein the second reflection module is disposed between the first reflection module and the second reflection module, wherein a third reflection module of the three reflection modules generates a partial high-beam light distribution without a light/dark border, which extends beyond the height of the horizon in front of the vehicle with an intended use of the headlamp.

2. The headlamp as set forth in claim 1, wherein at least one reflection module generates a light/dark border necessary for generating a low-beam light distribution conforming to regulations.

3. The headlamp as set forth in claim 1, wherein the light exit surfaces of the reflectors are the same size and in that the reflectors are disposed such that their light exit surfaces border on one another.

4. The headlamp as set forth in claim 1, wherein each semiconductor light source has semiconductor chips that are each disposed along a row, which row is disposed such that its longitudinal extension is transverse to the main beam direction of the reflector in a horizontal plane.

5. The headlamp as set forth in claim 1, wherein one of the three semiconductor light sources has a row of semiconductor chips that is disposed at a diagonal in a horizontal plane with an intended use of the headlight.

6. The headlamp as set forth in claim 1, wherein two reflection modules generate a high-beam light distribution.

7. The headlamp as set forth in Claim 1, wherein at least one reflection module, by the shape of its concave mirror reflector, acts to generate a fundamental light distribution, another of the pair is configured to generate a concentrated spot light distribution, and another pair is configured to generate a medium-wide light distribution, wherein the fundamental light distribution is wider than the medium-wide light distribution, and this is wider than the spot light distribution.

8. The headlamp as set forth in claim 7, wherein a first reflection module, by the vertical shape of its reflector, acts to generate the light/dark border, and by the horizontal shape of its reflector, acts to generate a medium-wide light distribution, while the second reflection module, by the horizontal shape of its reflector, acts to generate a wide fundamental light distribution.

9. The headlamp as set forth in claim 7, wherein the one second reflection module, by the vertical shape of its reflector, acts to generate the light/dark border, and by the horizontal shape of its reflector, to generate a medium-wide light distribution, while the first reflection module, by the horizontal shape of its reflector, acts to generate a wide light distribution.

10. The headlamp as set forth in claim 7, wherein both the first reflection module as well as the second reflection module, by the vertical shape of the respective reflector, act to generate the light/dark border, and the second reflection module, by the horizontal shape of its reflector, acts to generate a medium-wide light distribution, while the first reflection module, by the horizontal shape of its reflector, acts to generate a wide light distribution.

11. The headlamp as set forth in claim 7, wherein both the first reflection module as well as a second reflection module, by the vertical shape of their respective reflector, act to generate the light/dark border, and the first reflection module, by the horizontal shape of its reflector, acts to generate a medium-wide light distribution, while the second reflection module, by the horizontal shape of its reflector, acts to generate a wide light distribution.

12. The headlamp as set forth in claim 1, wherein at least one of the semiconductor light sources has a single chip light source or a double chip light source.

* * * * *